US010803788B2

(12) United States Patent
Lee et al.

(10) Patent No.: US 10,803,788 B2
(45) Date of Patent: Oct. 13, 2020

(54) DRIVING CIRCUIT FOR A LIGHT-EMITTING ELEMENT

(71) Applicant: AU Optronics Corporation, Hsin-Chu (TW)

(72) Inventors: Ming-Hsien Lee, Hsin-Chu (TW); Yi-Cheng Lin, Hsin-Chu (TW); Chuang-Cheng Yang, Hsin-Chu (TW); Kai-Wei Hong, Hsin-Chu (TW); Chun-Feng Lin, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/415,454

(22) Filed: May 17, 2019

(65) Prior Publication Data

US 2020/0160776 A1 May 21, 2020

(30) Foreign Application Priority Data

Nov. 16, 2018 (TW) ..... 107140908 A

(51) Int. Cl.
*G09G 3/32* (2016.01)

(52) U.S. Cl.
CPC ..... *G09G 3/32* (2013.01); *G09G 2300/0426* (2013.01); *G09G 2330/021* (2013.01)

(58) Field of Classification Search
CPC ..... H05B 45/10; H05B 45/20; H05B 45/40; H05B 47/11; H05B 47/16; G09G 3/32
See application file for complete search history.

(56) References Cited

U.S. PATENT DOCUMENTS

2006/0214596 A1* 9/2006 Miller ..... G09G 3/3233 315/169.3
2014/0085284 A1* 3/2014 Sun ..... G09G 3/3233 345/211
2015/0245442 A1* 8/2015 Hsu ..... H05B 45/44 315/294
2016/0125803 A1* 5/2016 Qing ..... G09G 3/3233 345/209
2017/0352304 A1* 12/2017 Funatsu ..... H01L 27/3211
2019/0110344 A1* 4/2019 Lo ..... H05B 45/10

FOREIGN PATENT DOCUMENTS

CN 104284478 1/2015
CN 107808604 3/2018
TW M431266 6/2012

* cited by examiner

*Primary Examiner* — Chun-Nan Lin
(74) *Attorney, Agent, or Firm* — WPAT, PC

(57) ABSTRACT

A driving circuit includes a first driving switch, a second driving switch and a current regulating unit. The first driving switch is electrically connected to a first power source and a first light emitting element. When the first driving switch is turned on, the first driving switch is configured to receive a first current. The second driving switch is electrically connected to a second power source and a second light emitting element. When the second driving switch is turned on, the second driving switch is configured to receive a second current. The current regulating unit is electrically connected to a negative terminal of the second light emitting element and a positive terminal of the first light emitting element. When the current regulating unit is disabled, the second current sequentially flows through the second light emitting element and the first light emitting element.

16 Claims, 7 Drawing Sheets

DRIVING CIRCUIT FOR A LIGHT-EMITTING ELEMENT

CROSS-REFERENCE TO RELATED APPLICATION

This application claims priority to Taiwan Application Serial Number 107140908, filed Nov. 16, 2018, which is herein incorporated by reference in its entirety.

BACKGROUND

Technical Field

The present disclosure relates to a driving circuit, and more particularly to a technology for providing current to drive a light-emitting element.

Description of Related Art

Micro LED is a technology for miniaturization and matrixing of light-emitting diodes. The Micro LED technology makes the LED volume less than 100 microns, so that each pixel can be individually addressed and driven separately, with high efficiency, high brightness, high reliability and fast response time. In addition, since the Micro LED does not require an additional backlight, it also has the advantages of energy saving, compact mechanism, and with small and thin size.

Although the Micro LED have the above advantages and can make the display thinner and lighter, there are still many improvements that can be improved for the driving circuit of the Micro LED.

SUMMARY

One aspect of the present disclosure is a driving circuit, including a first driving switch, a second driving switch and a current regulating unit. The first driving switch is electrically connected to a first power source and a first light emitting element. When the first driving switch is turned on, the first driving switch is configured to receive a first current provided by the first power source. The second driving switch is electrically connected to a second power source and a second light emitting element. When the second driving switch is turned on, the second driving switch is configured to receive a second current provided by the second power source. A negative terminal of the second light emitting element is electrically connected to a positive terminal of the first light emitting element. The current regulating unit is electrically connected to the negative terminal of the second light emitting element and the positive terminal of the first light emitting element. When the current regulating unit is disabled, the second current provided by the second power source sequentially flows through the second light emitting element and the first light emitting element.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

For the embodiment below is described in detail with the accompanying drawings, embodiments are not provided to limit the scope of the present disclosure. Moreover, the operation of the described structure is not for limiting the order of implementation. Any device with equivalent functions that is produced from a structure formed by a recombination of elements is all covered by the scope of the present disclosure. Drawings are for the purpose of illustration only, and not plotted in accordance with the original size.

It will be understood that when an element is referred to as being "connected to" or "coupled to", it can be directly connected or coupled to the other element or intervening elements may be present. In contrast, when an element to another element is referred to as being "directly connected" or "directly coupled," there are no intervening elements present. As used herein, the term "and/or" includes an associated listed items or any and all combinations of more.

In one of the driving circuits of the light-emitting diode, each light-emitting diode is electrically connected to a corresponding transistor switch to be driven to emit light as the transistor switch is turned on, or is extinguished as the transistor switch is turned off. However, when the above driving circuit is applied to a pixel circuit, there is a problem that the power is too large. For example, in the case that the pixel circuit includes 32 columns and 32 rows light-emitting diodes (i.e., includes 1024 light-emitting diodes), since each light-emitting diode is driven by an independent current, the total current of the driving circuit will cause the overall voltage drop (IR drop) to be too large, and must be improved.

Figure 1:
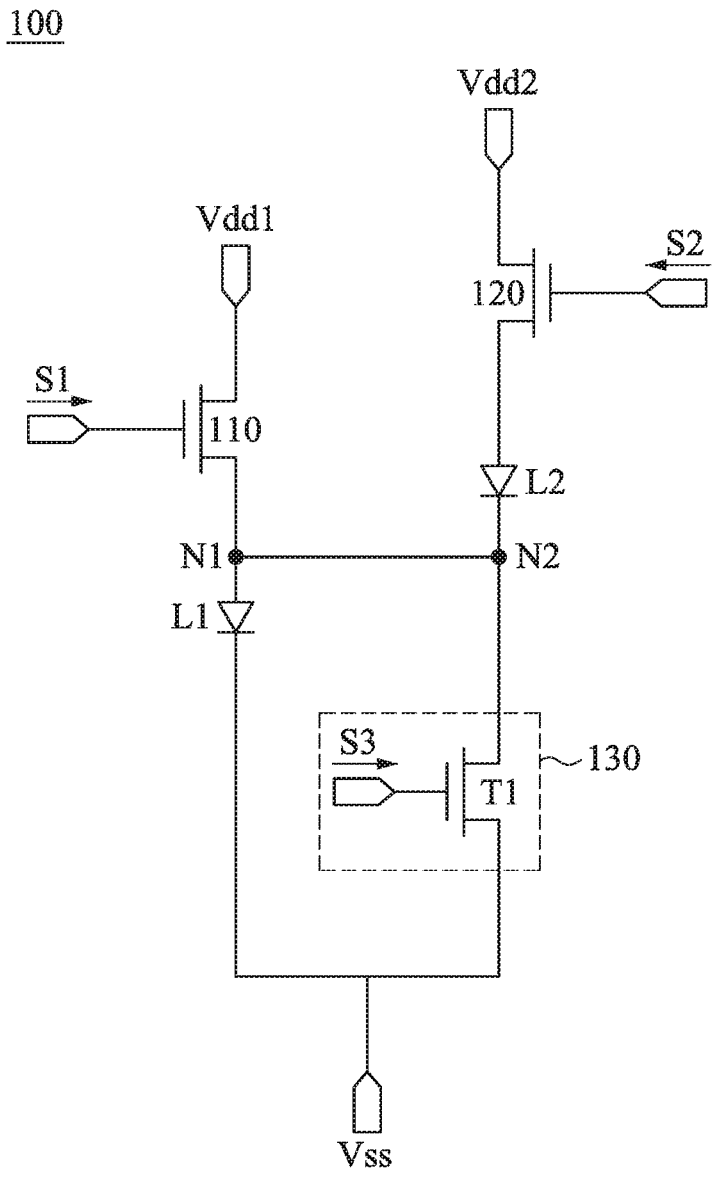
FIG. 1 is a schematic diagram of a driving circuit in some embodiments of the present disclosure.

Referring to the FIG. 1, FIG. 1 is a schematic diagram of a driving circuit in some embodiments of the present disclosure. The driving circuit 100 includes a first driving switch 110, a second driving switch 120, and a current regulating unit 130. The first driving switch 110 is electrically connected to the first power source Vdd1 and the first light emitting element L1. When the first driving switch 110 is turned on, the first light emitting element L1 receives a first current provided by the first power source Vdd1 through the first driving switch 110 to be driven to emit light. In some embodiments, the first driving switch 110 includes a transistor (e.g., field effect transistor, thin film transistor), and a control terminal of the first driving switch 110 is configured to receive a first control signal S1. When the first control signal S1 is enabled (e.g., high level), the first driving switch 110 is turned on. In contrast, when the first control signal S1 is disabled (e.g., low level), the first driving switch 110 is turned off.

The second driving switch 120 is electrically connected to the second power source Vdd2 and the second light emitting element L2. When the second driving switch 120 is turned on, the second light emitting element L2 receives a second current provided by the second power source Vdd2 through the second driving switch 120 to be driven by the second current to emit light. In some embodiments, the second driving switch 120 includes a transistor (e.g., a thin film transistor), and a control terminal of the second driving switch 120 is configured to receive a second control signal S2. When the second control signal S2 is enabled (e.g., high level), the second driving switch 120 is turned on. In contrast, when the second control signal S2 is disabled (e.g., low level), the second driving switch 120 is turned off.

A negative terminal of the second light emitting element L2 is electrically connected to a positive terminal of the first light emitting element L1. As shown in FIG. 1, in the present embodiment, the negative terminal of the second light emitting element L2 is electrically connected to a first node N1 between the first driving switch 110 and the positive terminal of the first light emitting element L1. The negative terminal of the second light emitting element L2 and the positive terminal of the first light emitting element L1 is a second node N2. In some embodiments, the first light emitting element L1 and the second light emitting element L2 are electrically connected through a short circuit path formed by the first node N1 and the second node N2. In addition, in some embodiments, the first light emitting element L1 and the second light emitting element L2 include a light-emitting diode, but are not limited thereto.

The current regulating unit 130 is electrically connected to the second node N2 between the negative terminal of the second light emitting element L2 and the positive terminal of the first light emitting element L1. When the current regulating unit 130 is disabled to form an open circuit, the second current provided by the second power source Vdd2 first flows through the second light emitting element L2, and then flows through the first light emitting element L1 through the second node N2 and the first node N1. Accordingly, since the driving circuit 100 drives the two light-emitting elements L1 and L2 through the same current, the power consumption generated by voltage decay can be reduced.

In some embodiments, the current regulating unit 130 includes a first transistor switch T1. The control terminal of the first transistor switch T1 is configured to receive a regulating signal S3, and is turned on or off according to the regulating signal S3. In other embodiments, the current regulating unit 130 can use other types of switching units.

As mentioned above, when the driving circuit 100 needs to simultaneously drive the first light emitting element L1 and the second light emitting element L2, since the second current provided by the second power source Vdd2 flows through the first light emitting element L1 and the second light emitting element L2 at the same time, in addition to improving the power of the driving circuit 100, it is ensured that the current flowing through the first light emitting element L1 and the second light emitting element L2 is the same. Accordingly, when the first light emitting element L1 and the second light emitting element L2 are the same light-emitting diodes of the same specification, the brightness of the first light emitting element L1 will be closer to the brightness of the second light emitting element L2.

Referring to FIG. 1, in some embodiments, the current regulating unit 130 and the negative terminal of the first light emitting element L1 are electrically connected to a reference voltage level (e.g., −3 volts). By controlling the first control signal S1, the second control signal S2 and the regulating signal S3, the driving circuit 100 can be operated in different states. Referring to Table 1 below, where the current in Table 1 is in milliamps and the power is in watts:

TABLE 1

| The present disclosure | | | | Other driving circuit | | | |
|---|---|---|---|---|---|---|---|
| I1 | I2 | Total current | Total power | I1 | I2 | Total current | Total power |
| 0 | 0 | 0 | 0 | 0 | 0 | 0 | 0 |
| 1 | 0 | 1 | 4.61 | 1 | 0 | 1 | 4.61 |
| 0 | 1 | 1 | 5.38 | 0 | 1 | 1 | 4.61 |
| 0 | 1 | 1 | 5.38 | 1 | 1 | 2 | 9.22 |
| 0.2 | 1 | 1.2 | 6.30 | 1.2 | 1 | 2.2 | 10.14 |
| 0 | 1 | 1 | 5.38 | 0.8 | 1 | 1.8 | 8.29 |

Figure 2A:
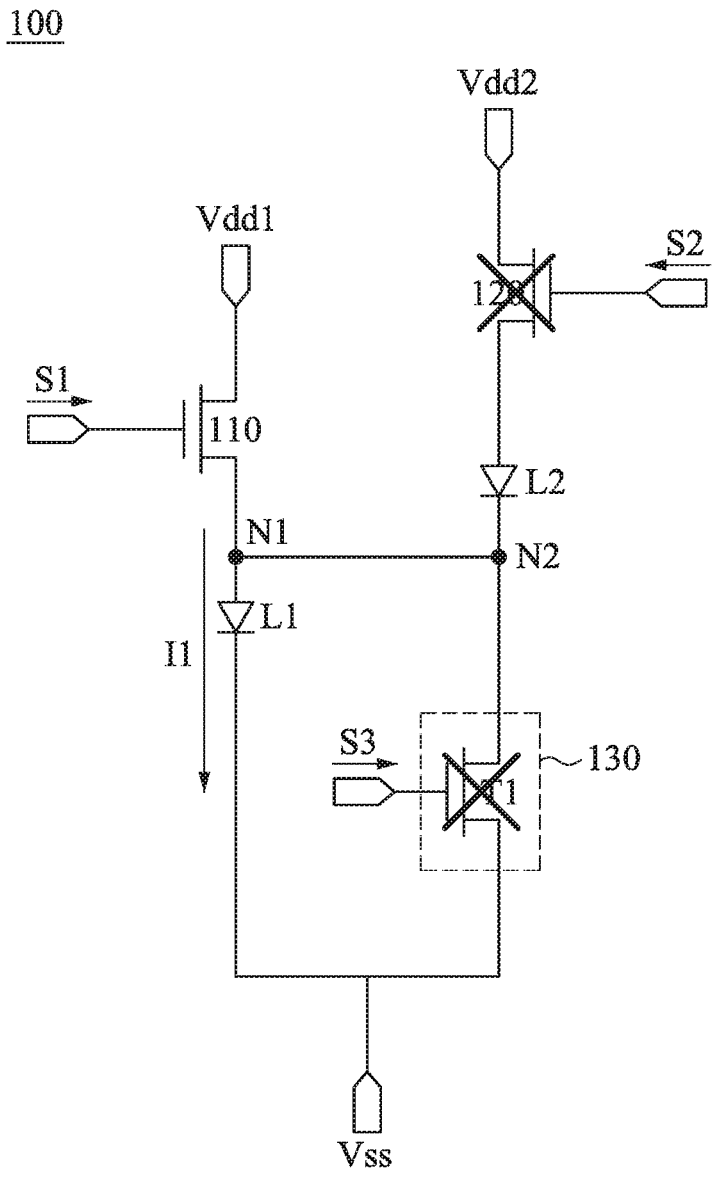
FIG. 2A-2E are schematic diagrams of operation states of the driving circuit in some embodiments of the present disclosure.

Referring to the FIG. 2A-2E. The different states of driving circuit 100 are described as follows. As shown in FIG. 2A, the first control signal S1 is the enable level so as to turn on the first driving switch 110. The second control signal S2 is a disable level so as to turn off the second driving switch 120. The current regulating unit 130 is disabled according to the regulating signal S3, and is in an open circuit state. At this time, the first current I1 provided by the first power source Vdd1 completely flows through the first light emitting element L1 to drive the first light emitting element L1 to emit light. In this embodiment, a first voltage value provided by the first power source Vdd1 is 6 volts, a second voltage value provided by the second power source Vdd2 is 7.5 volts, and a reference voltage Vss is −3 volts. Table 1 shows the power of the pixel circuit with 32 columns and 32 rows using the driving circuit 100 of the present disclosure to drive the light-emitting elements.

Figure 2B:
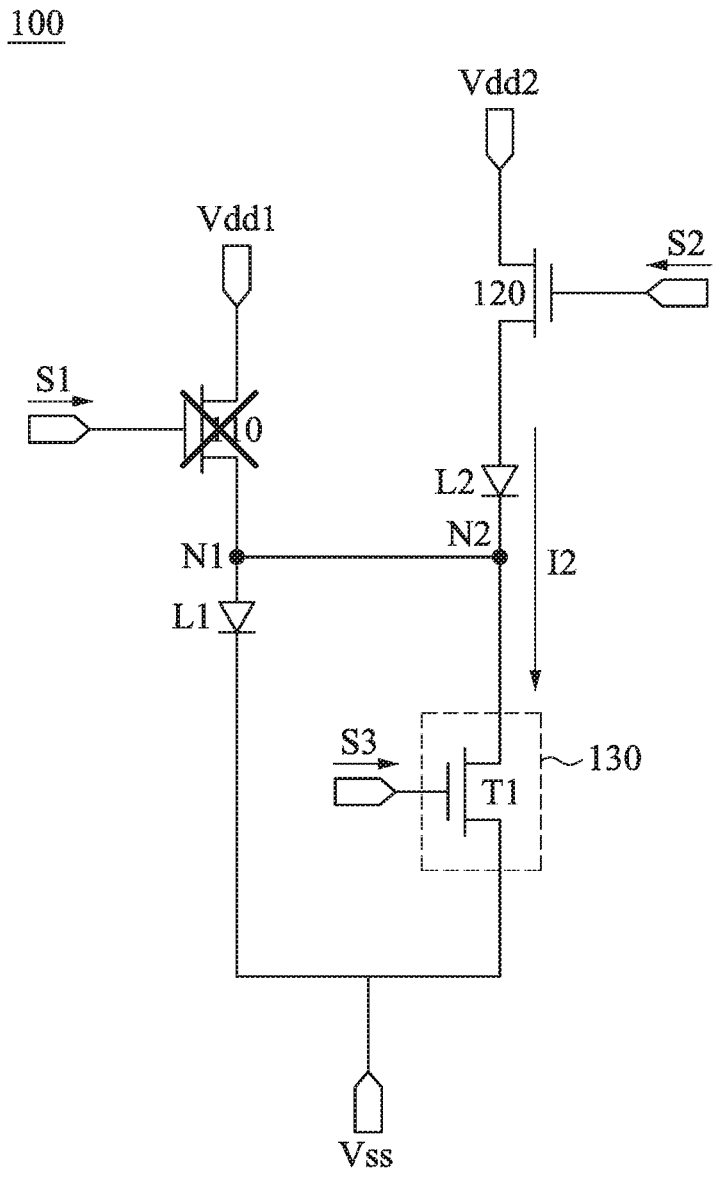

Similarly, as shown in FIG. 2B, the first control signal S1 is the disable level to turn off the first driving switch 110. The second control signal S2 is an enable level to turn on the second driving switch 120. The current regulating unit 130 is enabled according to the regent signal S3 and is in a short circuit state. At this time, the second current I2 provided by the second power source Vdd2 will completely flow through the second light emitting element L2 to drive the second light emitting element L2 to emit light.

In some embodiments, when the regulating signal S3 is at a high voltage level, the first transistor switch T1 is turned on to enable the current regulating unit 130. At this time, the impedance value of the first transistor switch T1 (or current regulating unit 130) is much smaller than the impedance value of the first light emitting element L1, so the second current I2 will completely flow through the first transistor switch T1 without being shunted to the first light emitting element L1.

Figure 2C:
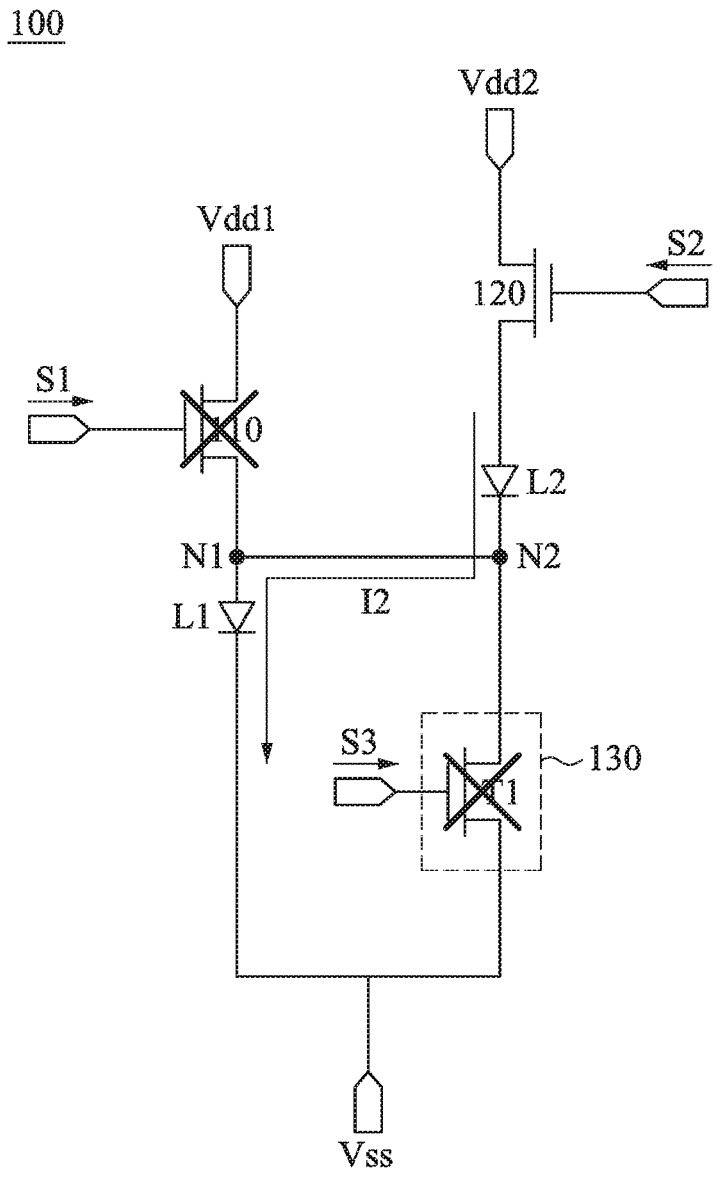

As shown in FIG. 2C, the first control signal S1 is the disable level to turn off the first driving switch 110. The second control signal S2 is an enable level to turn on the second driving switch 120. The current regulating unit 130 is disabled according to the regent signal S3 and is in an open circuit state. At this time, the second current I2 provided by the second power source Vdd2 will flow through the first light emitting element L1 after flowing through the second light emitting element L2. As shown in FIG. 2C, when the first light emitting element L1 and the second light emitting element L2 are driven, both the first driving switch 110 and the current regulating unit 130 are turned off, and only the second driving switch 120 is turned on in order to improve the power of the driving circuit 100.

In some embodiments, a first voltage value (e.g., 6 volts) provided by the first voltage source Vdd1 is less than a second voltage value (e.g., 7.5 volts) provided by the second power source Vdd2. Therefore, when the driving circuit 100 drives the first light emitting element L1 and the second light emitting element L2 at the same time (i.e., the state shown in FIG. 2C), the brightness of the first light emitting element L1 will be equal to or closer to the brightness of the first light emitting element L1, which is driven by the driving circuit 100 alone (i.e., the state shown in FIG. 2A).

Figure 2D:
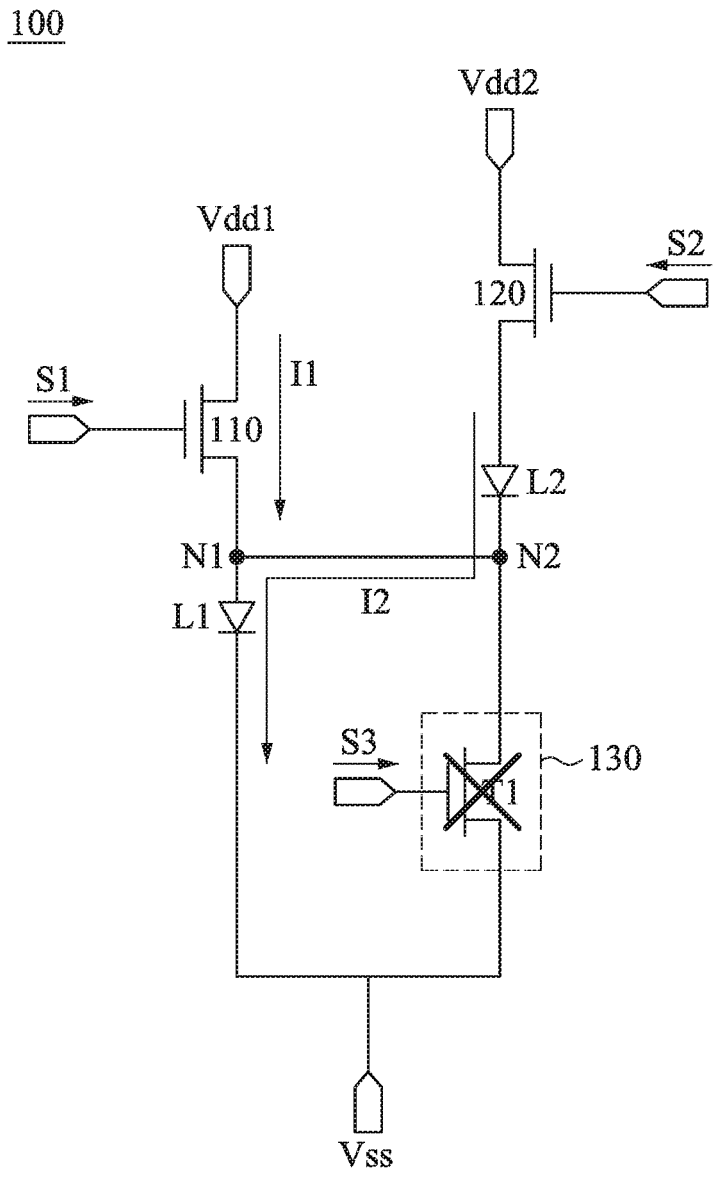

As shown in FIG. 2D, the first control signal S1 is the disable level to turn off the first driving switch 110. The second control signal S2 is a disable level to turn off the second driving switch 120. The current regulating unit 130 is disabled according to the regent signal S3 and is in an open circuit state. At this time, the first power source Vdd1 and the second power source Vdd2 provide the first current I1 and the second current I2, respectively. Since the second current I2 flows through the first light emitting element L1 after flowing through the second light emitting element L2, the first light emitting element L1 is simultaneously driven by the first current I1 and the second current I2.

In some embodiments, the first control signal S1 is further configured to control the impedance value of the first driving switch 110 to regulate the amount of the first current I1. For example, the first control signal S1 and the first power source Vdd1 control the first driving switch 110 in the linear region of the transistor, so that the first driving switch 110 operates as a variable resistor, and the impedance value of the first driving switch 110 changes with the first control signal S1. Accordingly, the dimming function of the driving circuit 100 can be achieved, and the brightness difference between the first light emitting element L1 and the second light emitting element L2 can be accurately controlled.

Figure 2E:
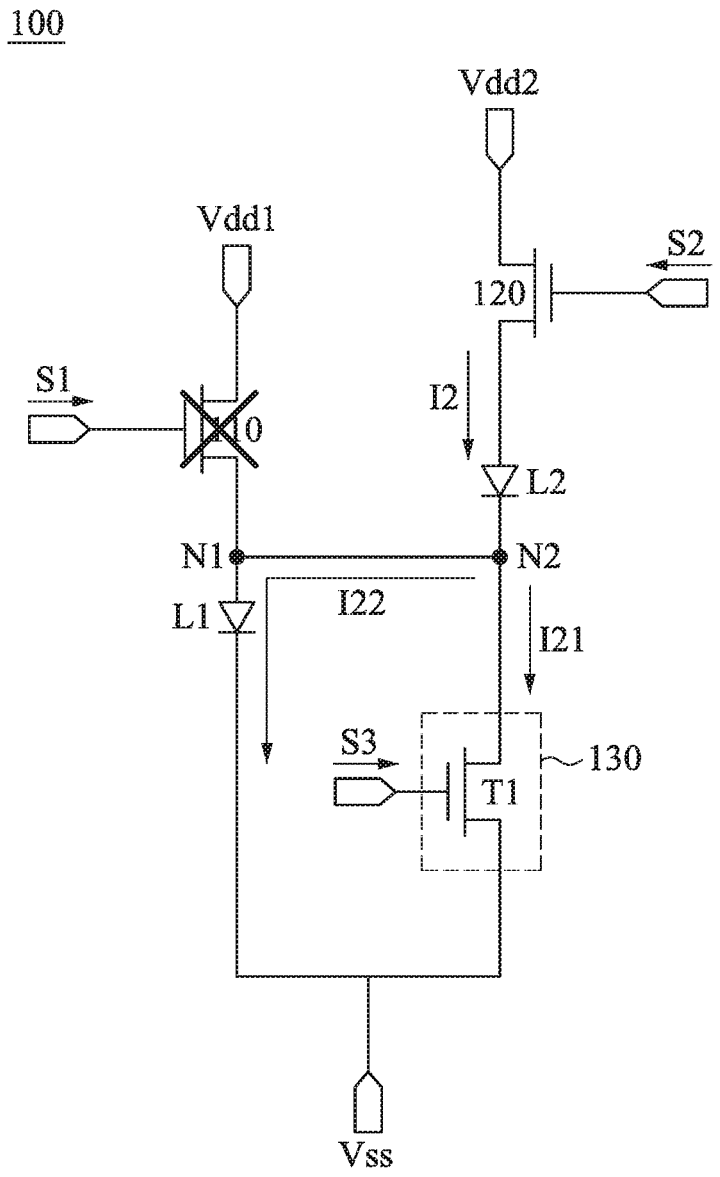

Similarly, in some embodiments, the regulating signal S3 may be further configured to change the impedance value of the first transistor switch T1 in the current regulating unit 130. As shown in FIG. 2E, the first control signal S1 is the disable level to turn off the first driving switch 110. The second control signal S2 is an enable level to turn on the second driving switch 120. The current regulating unit 130 is turned on according to the regulating signal S3 and has a predetermined impedance value. At this time, after the second current I2 flows through the second light emitting element L2, a portion (e.g., first portion) of the second current I21 will flow through the current regulating unit 130 according to the Voltage divider rule, and the other portion (e.g., second portion) of the second current I22 passes through the second node N2, the first node N1, and flows through and driven the first light emitting element L1. Accordingly, the first light emitting element L1 and the second light emitting element L2 are both driven by the second current I2, but the brightness of the second light emitting element L2 is brighter than the brightness of the first light emitting element L1. By regulating the amount of the regulating signal S3, the dimming function of the first light emitting element L1 can be achieved.

Figure 3:
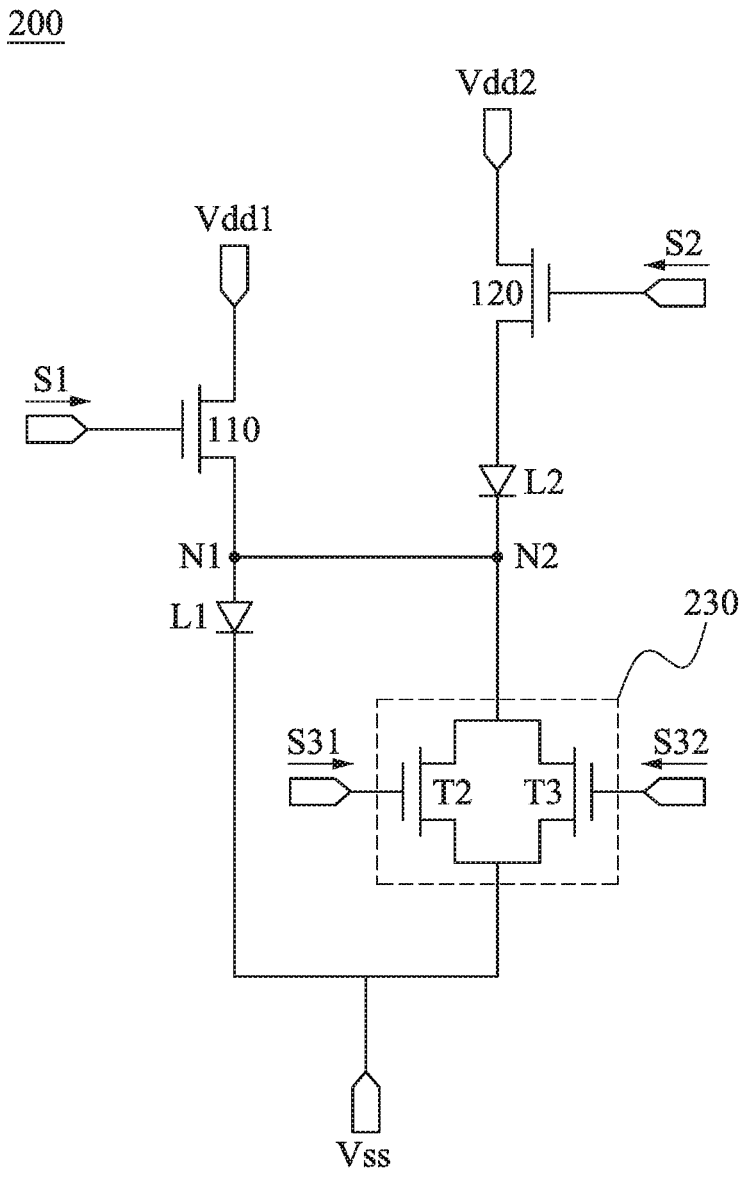
FIG. 3 is a schematic diagram of the driving circuit in some embodiments of the present disclosure.

Referring to the FIG. 3, FIG. 3 is a schematic diagram of the driving circuit 200 in some other embodiments of the present disclosure. The driving circuit 200 includes a first driving switch 110, a second driving switch 120, and a current regulating unit 230. The specific components of the similar component have been explained in detail in the previous paragraphs, and unless it has a cooperative Relationship with the components of FIG. 3, it is not repeated here.

As shown in FIG. 3, in this embodiment, the current regulating unit 230 includes a second transistor switch T2 and a third transistor switch T3. The second transistor switch T2 and the third transistor switch T3 are connected in parallel with each other. The control end of the second transistor switch T2 is configured to receive the first regulating signal S31 to be controlled to be turned on or off. The control end of the third transistor switch T3 is configured to receive the second regulating signal S32 to be controlled to be turned on or off. In some embodiments, the second transistor switch T2 includes an N-type Metal-Oxide-Semiconductor Field-Effect Transistor, and the third transistor switch T3 includes a P-type Metal-Oxide-Semiconductor Field-Effect Transistor. The second transistor switch T2 and the third transistor switch T3 are simultaneously turned on or off to form a transmission gate.

It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A driving circuit, comprising:

a first driving switch electrically connected to a first power source and a first light emitting element, wherein when the first driving switch is turned on, the first driving switch is configured to receive a first current provided by the first power source;

a second driving switch electrically connected to a second power source and a second light emitting element, wherein when the second driving switch is turned on, the second driving switch is configured to receive a second current provided by the second power source; a negative terminal of the second light emitting element is electrically connected to a positive terminal of the first light emitting element; and a current regulating unit electrically connected to the negative terminal of the second light emitting element and the positive terminal of the first light emitting element, when the current regulating unit is disabled, the second current provided by the second power source sequentially flows through the second light emitting element and the first light emitting element.

2. The driving circuit of claim 1, wherein a first voltage value provided by the first power source is less than a second voltage value provided by the second power source.

3. The driving circuit of claim 1, wherein the negative terminal of the second light emitting element is electrically connected to a first node between the first driving switch and the positive terminal of the first light emitting element.

4. The driving circuit of claim 3, wherein the current regulating unit and a negative terminal of the first light emitting element are electrically connected to a reference voltage level.

5. The driving circuit of claim 1, wherein a control terminal of the first driving switch receives a first control signal, a control terminal of the second driving switch receives a second control signal; when the first driving switch is turned on according to the first control signal, the second driving switch is turned off according to the second control signal, and the current regulating unit is disabled, the first light emitting element is driven by the first current.

6. The driving circuit of claim 1, wherein a control terminal of the first driving switch receives a first control signal, a control terminal of the second driving switch receives a second control signal; when the first driving switch is turned off according to the first control signal, the second driving switch is turned on according to the second control signal, and the current regulating unit is enabled, the second light emitting element is driven by the second current.

7. The driving circuit of claim 6, wherein an impedance value when the current regulating unit is enabled is less than an impedance value of the first light emitting element.

8. The driving circuit of claim 1, wherein a control terminal of the first driving switch receives a first control signal, a control terminal of the second driving switch receives a second control signal; when the first driving switch is turned off according to the first control signal, the second driving switch is turned on according to the second control signal, and the current regulating unit is disabled, the second current sequentially flows through the second light emitting element and the first light emitting element to drive the first light emitting element and the second light emitting element.

9. The driving circuit of claim 1, wherein a control terminal of the first driving switch receives a first control signal, a control terminal of the second driving switch receives a second control signal; when the first driving switch is turned on according to the first control signal, the second driving switch is turned on according to the second control signal, and the current regulating unit is disabled, the second light emitting element is driven by the second current, and the first light emitting element is driven by the first current and the second current.

10. The driving circuit of claim 9, wherein the first driving switch is turned on according to the first control signal, and the first control signal is further configured to control an impedance value of the first driving switch.

11. The driving circuit of claim 1, wherein a control terminal of the first driving switch receives a first control signal, a control terminal of the second driving switch receives a second control signal, and an impedance value of the current regulating unit is changed according to a regulating signal.

12. The driving circuit of claim 11, wherein when the first driving switch is turned off according to the first control signal, and the second driving switch is turned on according to the second control signal, a first portion of the second current flows through the current regulating unit, and the first light emitting element is driven by a second portion of the second current.

13. The driving circuit of claim 1, wherein the current regulating unit comprises a transistor switch.

14. The driving circuit of claim 1, wherein the current regulating unit comprises a N-type Metal-Oxide-Semiconductor Field-Effect Transistor and a P-type Metal-Oxide-Semiconductor Field-Effect Transistor in parallel with each other.

15. The driving circuit of claim 1, wherein the driving circuit is applied to a pixel circuit, and the first light emitting element and the second light emitting element comprise a light-emitting diode.

16. The driving circuit of claim 1, wherein the second driving switch, the second power source and the second light emitting element are connected in series.

* * * * *